US012510327B2

(12) United States Patent
Muska et al.

(10) Patent No.: US 12,510,327 B2
(45) Date of Patent: Dec. 30, 2025

(54) EQUIPMENT RAIL ATTACHMENT

(71) Applicant: Smith & Wesson Inc., Springfield, MA (US)

(72) Inventors: Simon M. Muska, Enfield, CT (US); Brady Hoddinott, New Hartford, CT (US)

(73) Assignee: Smith & Wesson Inc., Maryville, TN (US)

( * ) Notice: Subject to any disclaimer, the term of this patent is extended or adjusted under 35 U.S.C. 154(b) by 0 days.

(21) Appl. No.: 18/744,896

(22) Filed: Jun. 17, 2024

(65) Prior Publication Data

US 2024/0418478 A1 Dec. 19, 2024

Related U.S. Application Data

(60) Provisional application No. 63/508,417, filed on Jun. 15, 2023.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41C 23/10; F41A 21/48
See application file for complete search history.

(56) References Cited

U.S. PATENT DOCUMENTS 4,282,671 A * 8/1981 Wood ..... F41C 23/16 42/75.01
7,770,317 B1 8/2010 Tankersley
8,438,770 B2 5/2013 Troy
8,806,792 B2 8/2014 Yan et al.
(Continued)

FOREIGN PATENT DOCUMENTS

CN 112945009 B 12/2021

*Primary Examiner* — Joshua E Freeman
(74) *Attorney, Agent, or Firm* — Ballard Spahr LLP

(57) ABSTRACT

The invention discloses a hand guard connecting structure of a firearm, which has the advantages of simple structure, convenience in processing, quickness in disassembly and assembly, firmness in connection, reliability in positioning and good part assembly consistency. The utility model provides a hand protector section of thick bamboo connection structure of firearms, includes hand protector section of thick bamboo, lower case body, the polygon is personally submitted to hand protector section of thick bamboo transversal, is equipped with the rectangular channel on each face of hand protector section of thick bamboo respectively, still includes the connecting plate, the connecting plate is located the hand protector section of thick bamboo, and the lower surface of connecting plate is equipped with the boss, and the rectangular channel on boss and the hand protector section of thick bamboo bottom surface corresponds, and each boss joint is fixed in the rectangular channel that corresponds, is equipped with normal direction last screw hole on each boss respectively, it is equipped with down the screw hole to correspond on the case body down, and lower case body passes through screw, screw hole fixed connection with each boss, forms the fixed connection of hand protector section of thick bamboo, lower case body.

20 Claims, 5 Drawing Sheets

(56) References Cited

U.S. PATENT DOCUMENTS

| | | | | |
|---|---|---|---|---|
| 8,904,691 | B1 * | 12/2014 | Kincel | F41C 23/16 42/71.01 |
| 9,140,506 | B2 | 9/2015 | Gomez | |
| 9,389,043 | B1 * | 7/2016 | Zhang | F41C 23/16 |
| 10,145,648 | B1 * | 12/2018 | Holder | F41C 23/16 |
| D844,094 | S * | 3/2019 | Geissele | D22/108 |
| 10,401,122 | B2 | 9/2019 | Williams | |
| 10,670,369 | B1 | 6/2020 | Ding et al. | |
| 10,775,129 | B1 * | 9/2020 | Kincel | F41C 23/16 |
| 10,962,324 | B1 * | 3/2021 | Ding | F41G 11/004 |
| 11,408,696 | B2 | 8/2022 | Gerlings | |
| 2012/0131838 | A1 | 5/2012 | Edge et al. | |
| 2017/0059273 | A1 * | 3/2017 | Geissele | F41C 23/16 |
| 2018/0356181 | A1 * | 12/2018 | Williams | F41C 23/16 |
| 2020/0085127 | A1 * | 3/2020 | Garmon | A42B 1/0182 |
| 2022/0018629 | A1 * | 1/2022 | Senff | F41C 23/18 |
| 2022/0205746 | A1 * | 6/2022 | Wall | F41A 15/16 |

* cited by examiner

EQUIPMENT RAIL ATTACHMENT

CROSS-REFERENCE TO RELATED APPLICATION

This application claims priority to and the benefit of the filing date of U.S. Provisional Patent Application No. 63/508,417, filed Jun. 15, 2023, the entirety of which is hereby incorporated by reference herein.

FIELD

This disclosure relates to assemblies for attaching an equipment rail to an upper receiver of a firearm.

BACKGROUND

Equipment rails are advantageous for attaching various equipment, such as, for example, a tactical light, laser sight, vertical forward grip, or telescopic sight to a firearm. Although forming certain components of a firearm from polymer can be beneficial for various reasons, the material properties of polymer and the ways of forming the polymer (e.g., injection molding) create issues that do not permit use of polymer for conventional components.

SUMMARY

Aspects of this invention concern a firearm and assemblies for securing an equipment rail to an upper receiver of the firearm.

Accordingly to various aspects, an upper receiver assembly for a firearm includes an upper receiver, an equipment rail, and an equipment rail key. The equipment rail key is configured to couple (for example, via at least one threaded fastener) to the upper receiver with a portion of the equipment rail between the equipment rail key and the upper receiver to secure the equipment rail to the upper receiver. The equipment rail and equipment rail key cooperate to define a cam interface. The cam interface is configured to cause the equipment rail to be drawn against the upper receiver when the equipment rail key is tightened against the upper receiver.

In some embodiments, the equipment rail defines an opening that is configured to receive a portion of the equipment rail key therethrough.

In various aspects, the equipment rail defines a first feature, and the equipment rail key defines a second feature that cooperates with the first feature to permit receipt of the equipment rail key within the opening when the equipment rail key is properly oriented relative to the equipment rail and inhibit receipt of the equipment rail key within the opening when the equipment rail key is improperly oriented relative to the equipment rail. In one example, the first feature is a notch, wherein the second feature is a projection that is receivable into the notch when the equipment rail is in a proper orientation relative to the equipment rail.

In some aspects, the equipment rail key includes a bearing projection, and the upper receiver defines a slot that is configured to receive and bias against a surface of the bearing projection. In various aspects, the upper receiver includes an upper receiver insert that defines the slot of the upper receiver. In one example, the upper receiver insert defines at least one threaded opening that is configured to receive at least one threaded fastener.

In some embodiments, the equipment rail key includes a cam surface that partially defines the cam interface. In some examples, the assembly has a longitudinal axis, and the cam surface of the equipment rail key includes a planar surface that is oblique to the longitudinal axis of the assembly. In further exemplary aspects, the equipment rail includes a cam surface that is complementary to the cam surface of the equipment rail key. The cam surface of the equipment rail and the cam surface of the equipment rail key cooperate to define the cam interface.

In one example, the upper receiver includes at least one bearing surface. The equipment rail includes at least one corresponding bearing surface that is configured to bias against the at least one bearing surface of the upper receiver when the equipment rail is drawn against the upper receiver via the cam interface.

In various aspects, the upper receiver includes an upper receiver insert. The upper receiver insert defines at least one threaded opening that is configured to receive at least one fastener. In further aspects, the upper receiver insert is integrally molded into the upper receiver.

In some examples, the at least one fastener includes two screws. In further examples, the assembly includes the two screws.

The assembly has a longitudinal axis. In various aspects, the upper receiver includes a forward surface having generally octagonal cross sections in planes perpendicular to the longitudinal axis. The equipment rail includes a receptacle that is configured to receive the forward surface of the upper receiver. The receptacle has generally octagonal cross sections in planes perpendicular to the longitudinal axis.

A firearm comprising the upper receiver assembly is also disclosed.

A kit for constructing an upper receiver assembly is disclosed, the kit including an upper receiver, an equipment rail, and an equipment rail key. The equipment rail key is configured to couple (for example, via at least one threaded fastener) to the upper receiver with a portion of the equipment rail between the equipment rail key and the upper receiver to secure the equipment rail to the upper receiver. The equipment rail and equipment rail key cooperate to define a cam interface. The cam interface is configured to cause the equipment rail to be drawn against the upper receiver when the equipment rail key is tightened against the upper receiver.

Disclosed herein, in various embodiments, is method including the step of positioning a portion of an upper receiver within a portion of an equipment rail. An equipment rail key is positioned on an outer surface of the equipment rail. The equipment rail key is tightened against the upper receiver to draw the equipment rail against the upper receiver via a cam interface between the equipment rail and the equipment rail key.

DETAILED DESCRIPTION

Figure 1:
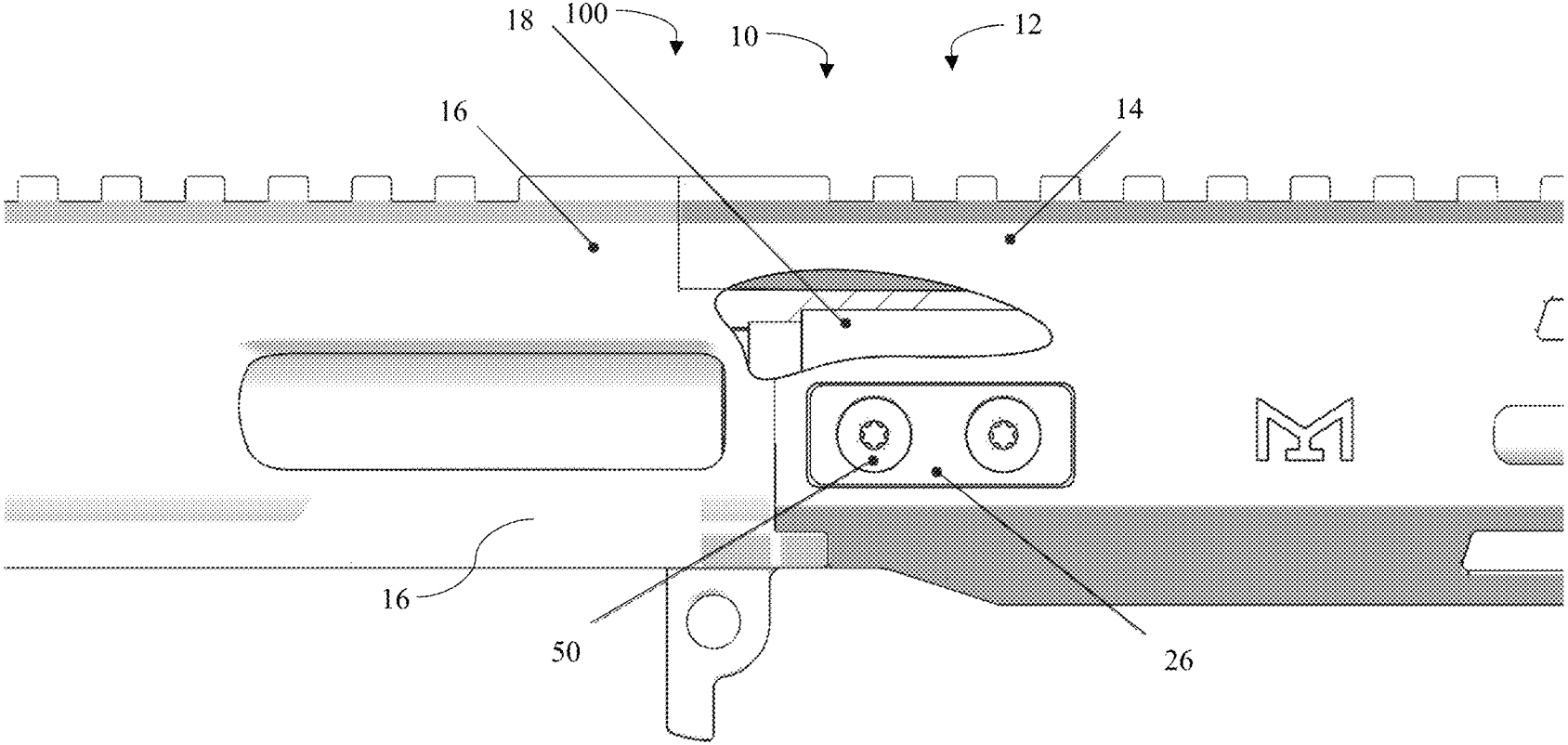
FIG. 1 is a partial side view of a firearm illustrating an upper receiver assembly for attaching an equipment rail to an upper receiver.

FIG. 1 is a partial side view of a portion of a firearm 10 showing an upper receiver assembly 12 that attaches an equipment rail 14 to an upper receiver 16 according to aspects of this invention. The disclosed assembly provides various advantages over conventional attachment means, such as ease of assembly and disassembly and absence of slop from machining tolerance limitations. Further, the disclosed assembly permits use of polymer components that are not compatible with conventional attachment means.

Figure 2:
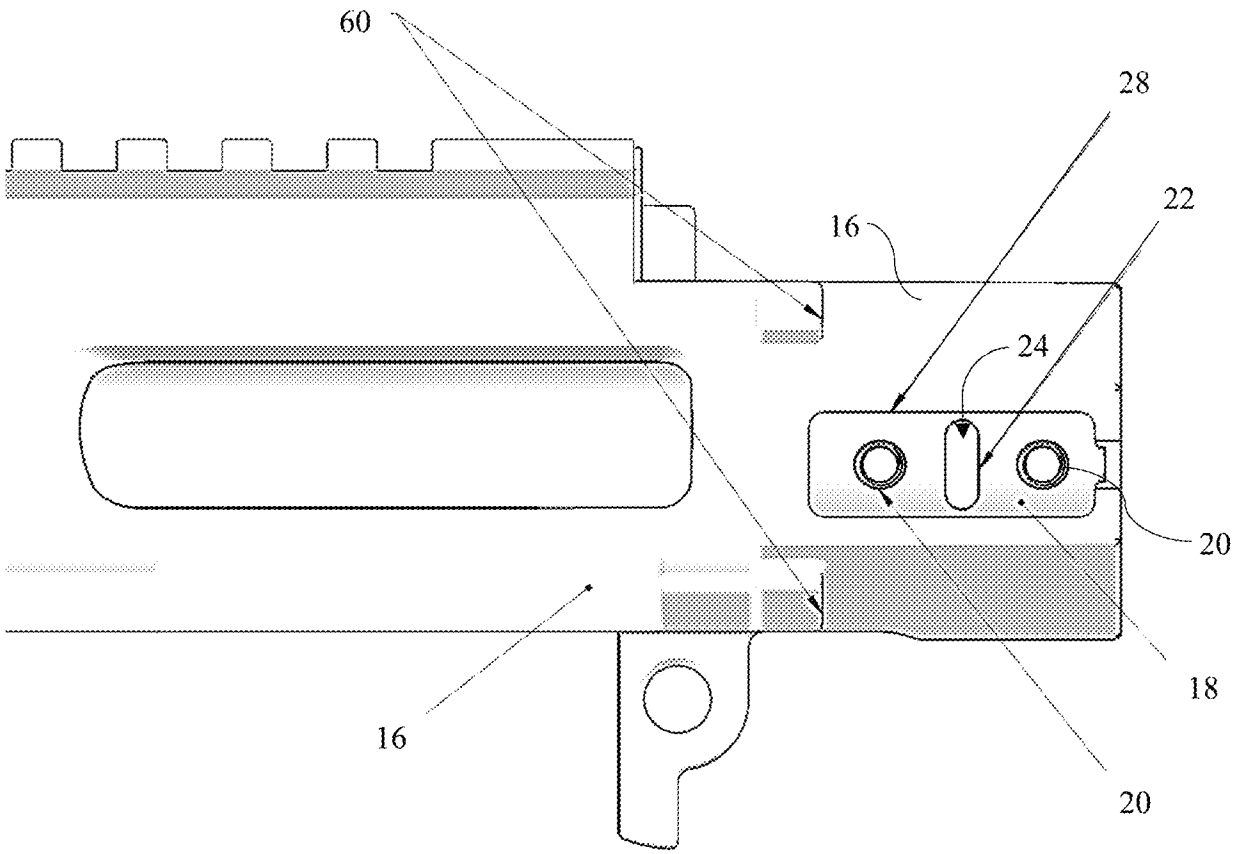
FIG. 2 is a partial side view of the upper receiver of the upper receiver assembly of FIG. 1.

In this example, the firearm 10 is a pistol caliber carbine, however, embodiments for use with other firearms, such as other semi-automatic rifles, are disclosed. Referring also to FIG. 2, the upper receiver 16 includes an upper receiver insert 18 that is received within and, optionally, integrally molded within, a polymer upper receiver body. The upper receiver insert 18 defines at least one threaded opening 20 (in this example, a pair of threaded openings). The upper receiver insert 18 further defines a bearing surface 22, provided in this example as the side surface of a slot 24.

Referring to FIGS. 1, 3, and 4A-4C, the upper receiver assembly 12 comprises an equipment rail key 26 that is configured to engage the equipment rail 14 and the upper receiver 16 to secure the equipment rail to the upper receiver. The equipment rail 14 defines an opening 28 that is configured to receive a portion of the equipment rail key 26 therethrough.

Figure 3:
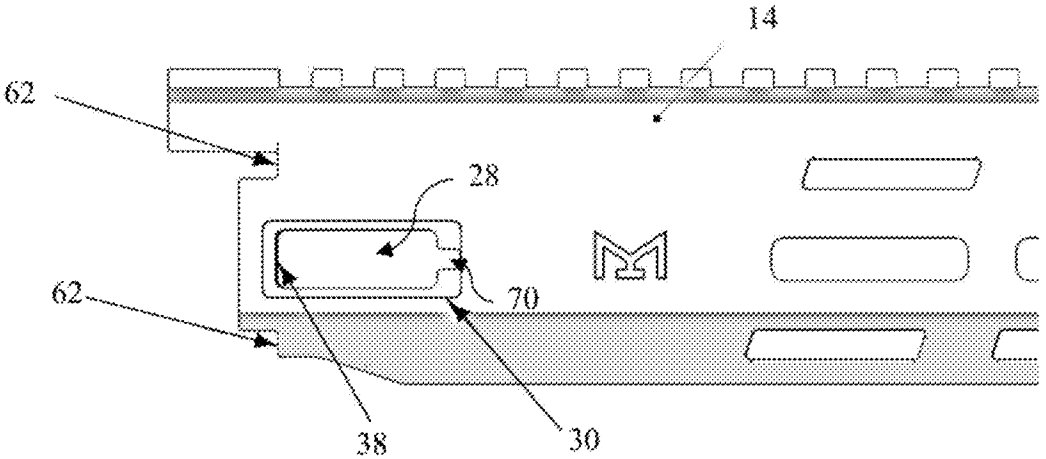
FIG. 3 is a partial side view of the equipment rail of the upper receiver assembly of FIG. 1.

As shown in FIG. 3, the equipment rail 14 further defines a recess 30 that at least partially surrounds the opening 28. The recess 30 receives a base 32 of the equipment rail key 26 so that the equipment rail key 26 lies flush with an outer surface of the equipment rail 14. The portion of the equipment rail 14 defining the recess 30 can be held between the base 32 and the upper receiver 16 to secure the equipment rail 14 to the upper receiver.

Figure 4B:
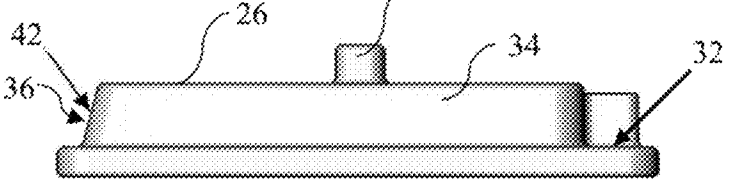
FIGS. 4A-4C show, respectively, an inner side view, a top end view, and a bottom end view of an equipment rail key of the upper receiver assembly of FIG. 1.
Figure 4A:
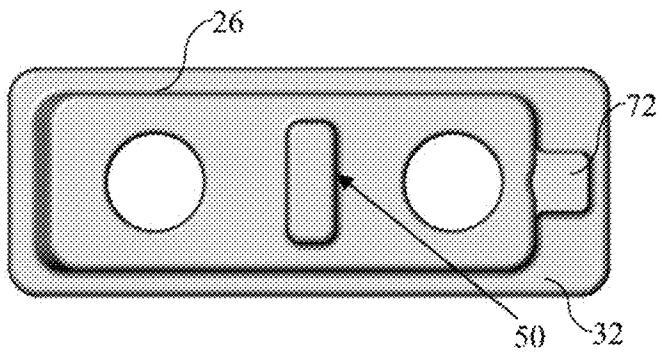
Figure 4C:
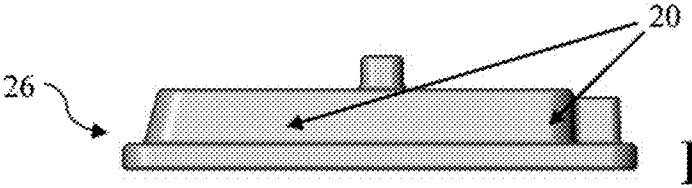
Figure 6:
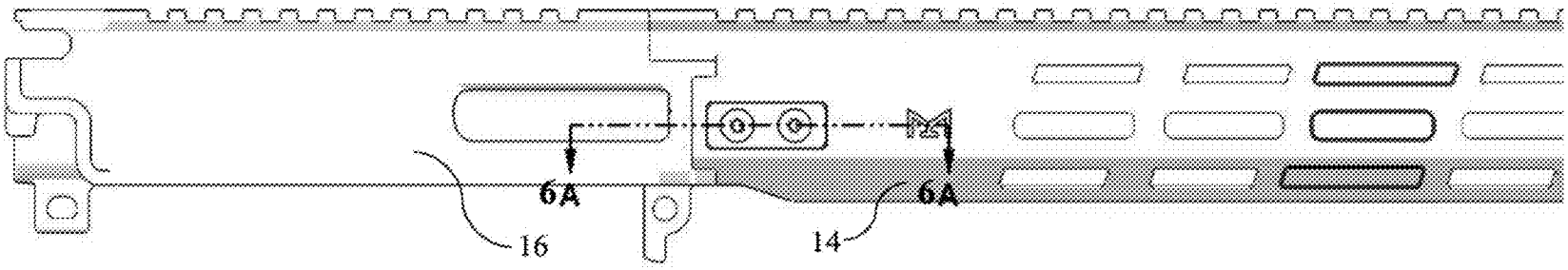
FIG. 6 is a partial side view of the firearm of FIG. 1.
Figure 6A:
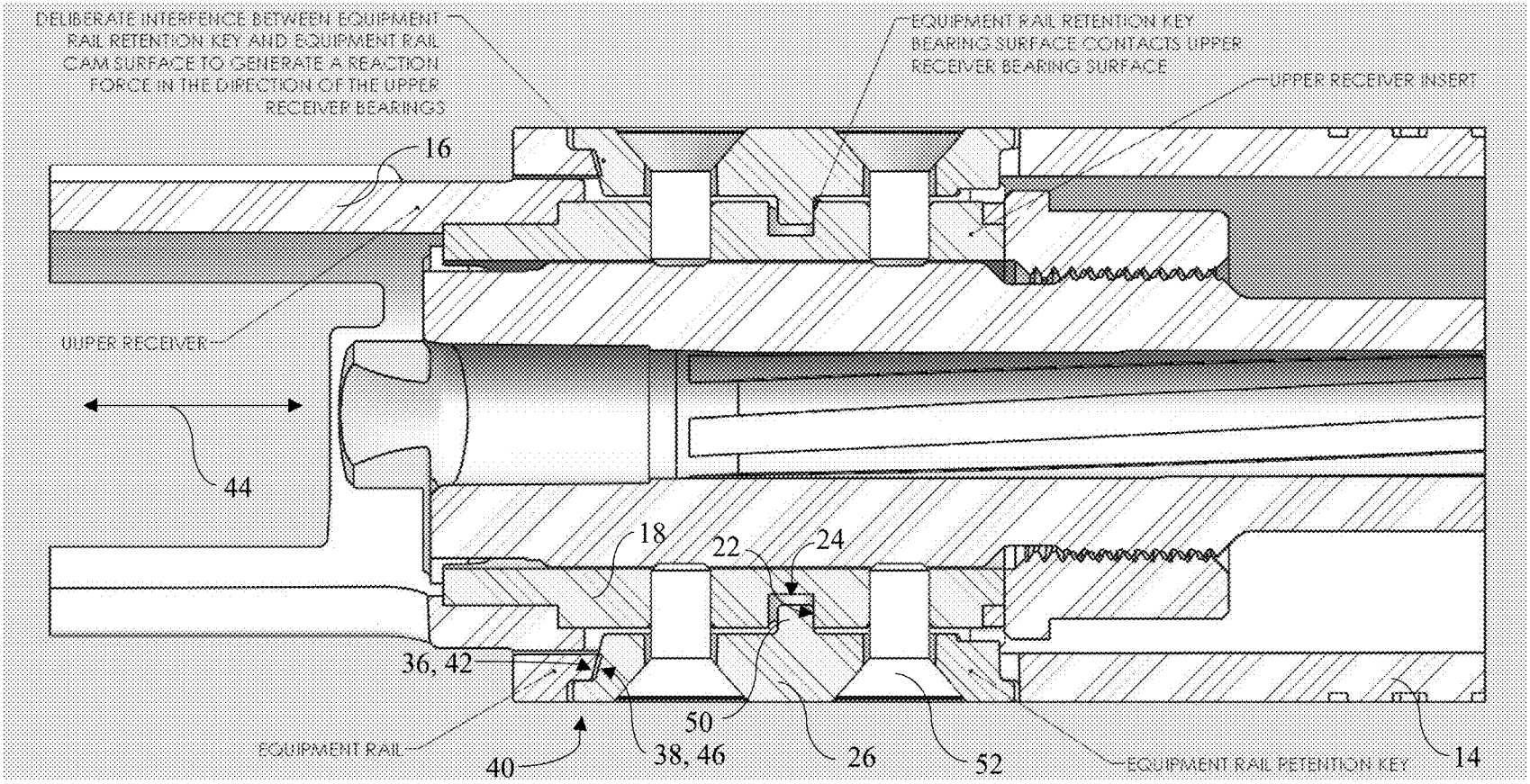
FIG. 6A is a partial cross-sectional view of the firearm taken in the plane 6A-6A of FIG. 6.

Referring also to FIG. 6A, the equipment rail key 26 further comprises a body 34 that projects inwardly from the base 32. Body 34 defines a peripheral surface 36 that engages a corresponding surface 38 of the equipment rail 14 that defines the opening 28 to form a cam interface 40 that causes the equipment rail to be drawn against the upper receiver when the equipment rail key 26 is tightened against the upper receiver 16 as further disclosed herein. Referring to FIGS. 4B and 6A, in this example, the equipment rail key 26 includes a cam surface 42 that partially defines the cam interface 40. The cam surface 42 of the equipment rail key 26 includes and, optionally, can be defined by, a planar surface that is oblique to a longitudinal axis 44 of the assembly 12. The equipment rail 14 comprises a cam surface 46 that is complementary to the cam surface 42 of the equipment rail key 26. The cam surface 46 of the equipment rail 14 and the cam surface 42 of the equipment rail key 26 cooperate to define the cam interface 40.

Referring to FIGS. 2 and 4A-4C, the equipment rail key 26 comprises a bearing projection 50 that extends inwardly from the body 34 of the equipment rail key 26 and is received within the slot 24. The bearing projection 50 engages the bearing surface 22 of the slot 24. Fasteners 52 extend through respective openings in the equipment rail key 26 and are received within the threaded openings 20. As the fasteners 52 are tightened down into the threaded openings 20, the equipment rail key 26 is drawn inwardly. Engagement between the bearing projection 50 and the slot 24 fix an axial position of the equipment rail key 26 relative to the upper receiver 16, so the inward movement of the equipment rail key 26 causes sliding engagement between the cam interface 40 to draw the equipment rail 14 axially toward the upper receiver 16. The illustrated fasteners 52 are flathead screws having tapers that are receivable into countersunk bores. However, other suitable threaded fasteners are contemplated for securing the equipment rail key 26 to the upper receiver 16, thereby drawing the equipment rail key against equipment rail 14. In additional embodiments, the fastener(s) may be non-threaded fasteners, such as, for example, rivets. In further aspects, the equipment rail key 26 can be coupled to the upper receiver 16 via an interlocking structure that does not require any additional fastener. For example, the equipment rail key 26 can comprise a detent that engages the upper receiver 16. Such a detent can comprise a flexible protrusion comprising a hook, wherein the flexible protrusion is configured to deflect to permit the hook to engage the upper receiver 16. The flexible protrusion can comprise an angled surface that is configured to slide against the upper receiver 16 to gradually deflect the flexible protrusion as the flexible protrusion moves toward engagement between the hook and the upper receiver 16.

Figure 5:
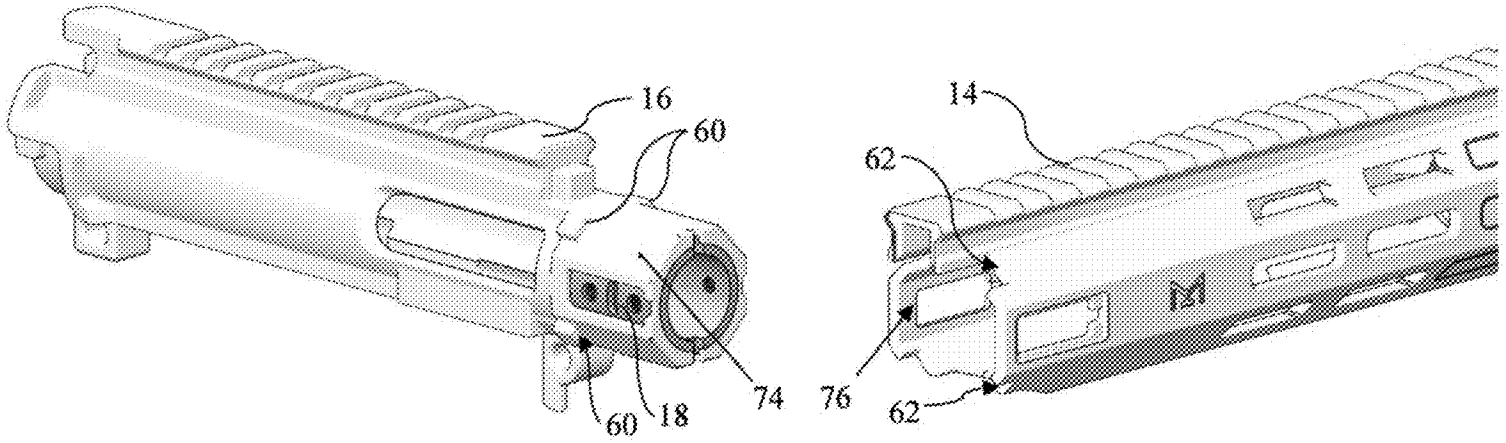
FIG. 5 is a disassembled view of the equipment rail and upper receiver of the upper receiver assembly of FIG. 1.

Referring to FIGS. 2, 3, and 5, the equipment rail 14 defines a first bearing surface 60, and the upper receiver 16 defines an opposed bearing surface 62. The cam interface 40 draws the equipment rail 14 toward the upper receiver 16 until the first bearing surface 60 engages the opposed bearing surface 62.

The equipment rail 14 and the equipment rail key 26 are configured to permit engagement in only one orientation. For example, in the configuration depicted in FIGS. 3 and 4A-4B, the equipment rail 14 defines a notch 70 (optionally, a plurality of notches), and the equipment rail key 26 defines a projection 72 (optionally, a plurality of projections) that is receivable into the notch when the equipment rail is in a proper orientation relative to the equipment rail. Accordingly, if the equipment rail key 26 is inadvertently flipped 180 degrees about an axis extending through the threaded openings 20, the equipment rail key is inhibited from engaging the equipment rail 14. In various aspects, other respective features of the equipment rail 14 and the equipment rail key 26 can be implemented to permit receipt of the equipment rail key within the opening when the equipment rail key is properly oriented relative to the equipment rail and inhibit receipt of the equipment rail key within the opening when the equipment rail key is improperly oriented relative to the equipment rail. Generally, at least a portion of the opening 28 can have a surface that is complementary to a corresponding surface of the equipment rail key 26. For example, the equipment rail 14 can define one or more projections, and the equipment rail key 26 can define one or more notches, with the projection(s) of the equipment rail being receivable into corresponding notches of the equipment rail key. In further aspects, at least a portion of a perimeter of the equipment rail key 26 that is received within and positioned against the equipment rail 14 can be asymmetric about a vertical plane that bisects the equipment rail. In other aspects, one or more surfaces of the equipment rail key 26 that engage the equipment rail 14 can have a single degree of rotational symmetry that permits receipt within the opening 28 of the equipment rail key in only one orientation. In this example, the equipment rail key 26 is symmetric about a plane that bisects the equipment rail key 26 and includes or is parallel to the longitudinal axis 44.

Referring to FIG. 5, a portion of the equipment rail 14 is received within the upper receiver 16. In this example, the upper receiver 16 comprises a forward surface 74 having generally octagonal cross sections in planes perpendicular to the longitudinal axis 44. The equipment rail 14 comprises a receptacle 76 that receives the forward surface 74, the receptacle 76 having generally octagonal cross sections in planes perpendicular to the longitudinal axis. The octagonal profile can inhibit rotation of the equipment rail 14 relative to the upper receiver 16. More generally, the octagonal profile provides an economical and secure structure for attachment.

Referring to FIG. 1, in some aspects, a kit 100 including the equipment rail 14, the upper receiver 16, and the equipment rail key 26 is provided. The kit can be assembled to provide the upper receiver assembly 12.

Optionally, in various aspects, the equipment rail comprises molded polymer. The equipment rail keys 26 and upper receiver insert 18 are formed from metal.

Although two equipment rail keys 26 are shown on opposite sides of the firearm, it is contemplated that any number of keys can be used, depending on the load requirements. For example, three or more equipment rail keys can be used for higher load requirements.

Conventional systems for attaching equipment rails are not suitable for polymer equipment rails. With conventional systems, an equipment rail engages with a small shoulder of a barrel nut and fastens with a clamshell-type configuration and series of screws. Such an arrangement is not suitable for use with a polymer handguard or equipment rail. For example, polymer does not provide the requisite interference to provide the necessary structural integrity. Further, given the material properties of polymer, it is impractical to provide an assembly flange or shoulder that a retention nut engages for securing the equipment rail. This is particularly a concern for long equipment rails. The disclosed assemblies provide a way to securely attach the equipment rail to the firearm. The disclosed assemblies can substantially or entirely eliminate any slop in the attachment of the equipment rail. No special tooling or long drivers are required for assembly over the barrel of the firearm. Forming the equipment rail from polymer permits designed-in interference that pre-loads the polymer to further reduce slop. Still further, the disclosed assemblies permit quick and easy assembly and disassembly.

Additional details of an exemplary firearm as disclosed herein are provided in U.S. Provisional Patent Application No. 63/508,426, filed Jun. 15, 2024, the entirety of which is hereby incorporated by reference herein.

Although the disclosed assemblies provides advantages for use with polymer components of firearms, it should be understood that the assemblies disclosed herein can be used with metallic constructions as well.

What is claimed is:

1. An upper receiver assembly for a firearm, comprising:
an upper receiver;
an equipment rail; and
an equipment rail key,
wherein the equipment rail key is configured to couple to the upper receiver with a portion of the equipment rail between the equipment rail key and the upper receiver to secure the equipment rail to the upper receiver,
wherein the equipment rail and equipment rail key cooperate to define a cam interface, wherein the cam interface is configured to cause the equipment rail to be drawn against the upper receiver when the equipment rail key is secured against the upper receiver.

2. The assembly of claim 1, wherein the equipment rail defines an opening that is configured to receive a portion of the equipment rail key therethrough.

3. The assembly of claim 2, wherein the equipment rail defines a first feature, wherein the equipment rail key defines a second feature that cooperates with the first feature to permit receipt of the equipment rail key within the opening when the equipment rail key is properly oriented relative to the equipment rail and inhibit receipt of the equipment rail key within the opening when the equipment rail key is improperly oriented relative to the equipment rail.

4. The assembly of claim 3, wherein the first feature is a notch, wherein the second feature is a projection that is receivable into the notch when the equipment rail is in a proper orientation relative to the equipment rail.

5. The assembly of claim 1, wherein the equipment rail key comprises a bearing projection, wherein the upper receiver defines a slot that is configured to receive and bias against a surface of the bearing projection.

6. The assembly of claim 5, wherein the upper receiver comprises an upper receiver insert that defines the slot of the upper receiver.

7. The assembly of claim 1, wherein the equipment rail key comprises a cam surface that partially defines the cam interface.

8. The assembly of claim 7, wherein the assembly has a longitudinal axis, wherein the cam surface of the equipment rail key comprises a planar surface that is oblique to the longitudinal axis of the assembly.

9. The assembly of claim 7, wherein the equipment rail comprises a cam surface that is complementary to the cam surface of the equipment rail key, wherein the cam surface of the equipment rail and the cam surface of the equipment rail key cooperate to define the cam interface.

10. The assembly of claim 1, wherein the upper receiver comprises at least one bearing surface, wherein the equipment rail comprises at least one corresponding bearing surface that is configured to bias against the at least one bearing surface of the upper receiver when the equipment rail is drawn against the upper receiver via the cam interface.

11. The assembly of claim 1, wherein the equipment rail key is configured to couple to the upper receiver via at least one threaded fastener.

12. The assembly of claim 11, wherein the upper receiver comprises an upper receiver insert, wherein the upper receiver insert defines at least one threaded opening that is configured to receive the at least one fastener.

13. The assembly of claim 12, wherein the upper receiver insert is integrally molded into the upper receiver.

14. The assembly of claim 11, wherein the at least one threaded fastener comprises two screws, wherein the assembly comprises the two screws.

15. The assembly of claim 1, wherein the assembly has a longitudinal axis, wherein the upper receiver comprises a forward surface having generally octagonal cross sections in planes perpendicular to the longitudinal axis, wherein the equipment rail comprises a receptacle that is configured to receive the forward surface of the upper receiver, wherein the receptacle has generally octagonal cross sections in planes perpendicular to the longitudinal axis.

16. A firearm comprising the upper receiver assembly as in claim 1.

17. The assembly of claim 1, wherein the assembly has a longitudinal axis, wherein the cam interface is configured to cause the equipment rail to be drawn against the upper receiver in a direction along the longitudinal axis when the equipment rail key is tightened against the upper receiver.

18. A kit for constructing an upper receiver assembly, comprising:

an upper receiver;

an equipment rail; and an equipment rail key, wherein the equipment rail key is configured to couple to the upper receiver with a portion of the equipment rail between the equipment rail key and the upper receiver to secure the equipment rail to the upper receiver, wherein the equipment rail and equipment rail key cooperate to define a cam interface, wherein the cam interface is configured to cause the equipment rail to be drawn against the upper receiver when the equipment rail key is secured against the upper receiver.

19. The kit of claim 18, wherein the equipment rail defines an opening that is configured to receive a portion of the equipment rail key therethrough.

20. A method comprising:

positioning a portion of an upper receiver within a portion of an equipment rail;

positioning an equipment rail key on an outer surface of the equipment rail; and tightening of the equipment rail key against the upper receiver to draw the equipment rail against the upper receiver via a cam interface between the equipment rail and the equipment rail key.

* * * * *